United States Patent [19]

Cooksey

[11] Patent Number: 4,736,175

[45] Date of Patent: Apr. 5, 1988

[54] POLARIZED ROTARY SOLENOID

[75] Inventor: George E. Cooksey, Ridgecrest, Calif.

[73] Assignee: The United States of America as represented by the Secretary of the Navy, Washington, D.C.

[21] Appl. No.: 14,904

[22] Filed: Feb. 9, 1987

[51] Int. Cl.[4] ..... H01T 7/08

[52] U.S. Cl. ..... 335/230; 335/272

[58] Field of Search ..... 335/78, 79, 80, 81, 335/84, 229, 230, 234, 272

[56] References Cited

U.S. PATENT DOCUMENTS

| | | | |
|---|---|---|---|
| 2,364,656 | 12/1944 | Price | 175/336 |
| 2,449,901 | 9/1948 | Kaiser | 175/337 |
| 2,846,623 | 8/1958 | Wolff | 317/180 |
| 3,198,995 | 8/1965 | Grebe | 335/234 |
| 3,202,885 | 8/1965 | Sohns | 317/165 |
| 3,229,170 | 1/1966 | Daugherty et al. | 317/197 |
| 3,229,171 | 1/1966 | Daugherty | 317/197 |
| 3,906,416 | 9/1975 | Sprando | 335/234 X |
| 3,928,988 | 12/1975 | Luth | 335/234 X |

FOREIGN PATENT DOCUMENTS

| | | | |
|---|---|---|---|
| 1270691 | 6/1968 | Fed. Rep. of Germany | 335/230 |
| 963666 | 1/1950 | France | 335/230 |

*Primary Examiner*—George Harris

*Attorney, Agent, or Firm*—W. C. Townsend; W. Thom Skeer; Stephen J. Church

[57] ABSTRACT

A rotary solenoid providing opposite direction pivotal movement on opposite polarity d.c. energization. The solenoid has a pivoting shaft from which a permanent magnet armature having ends of opposite magnetic polarity extends transversely and oppositely. The armature is disposed between a pair of pole pieces each of which extends along the armature between its ends. The pole pieces are oppositely electromagnetically magnetized by a d.c. winding so that reversing the electrical polarity of the winding reverses the polarity of each pole piece and its attraction or repulsion of the armature ends. The pole pieces are opposite arms of a U-shaped ferromagnetic structure on which the winding is centrally wound, and the shaft is supported by a bearing in a nonferromagnetic bridge between the pole pieces.

1 Claim, 2 Drawing Sheets

Fig. 1
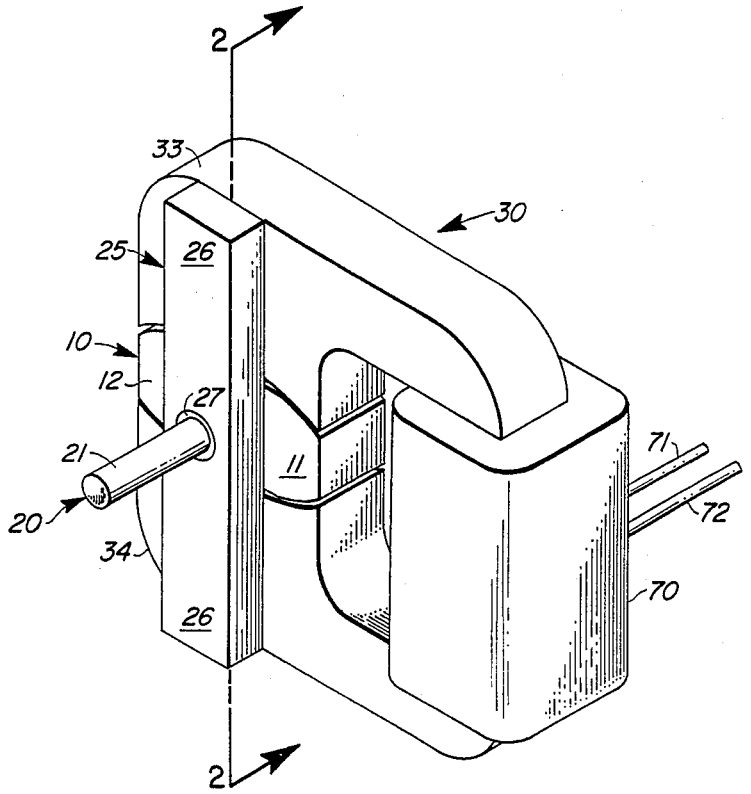
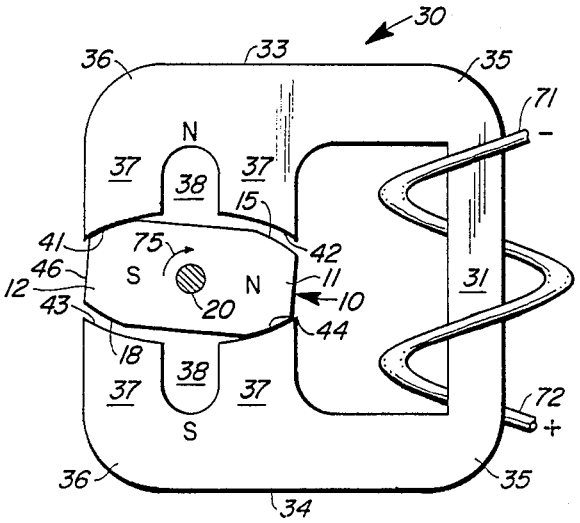
Fig. 2A
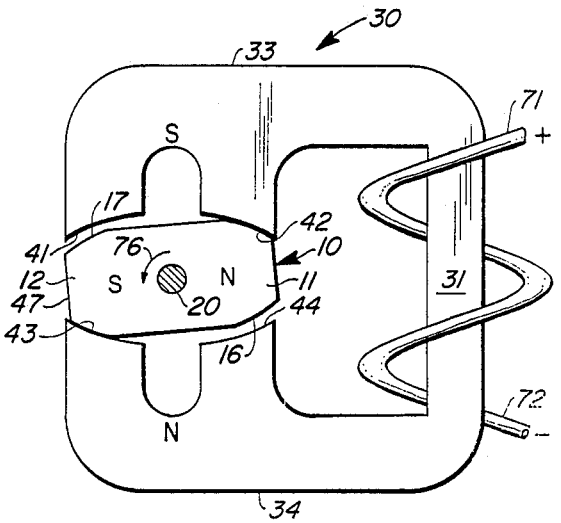
Fig. 2B

Fig. 3
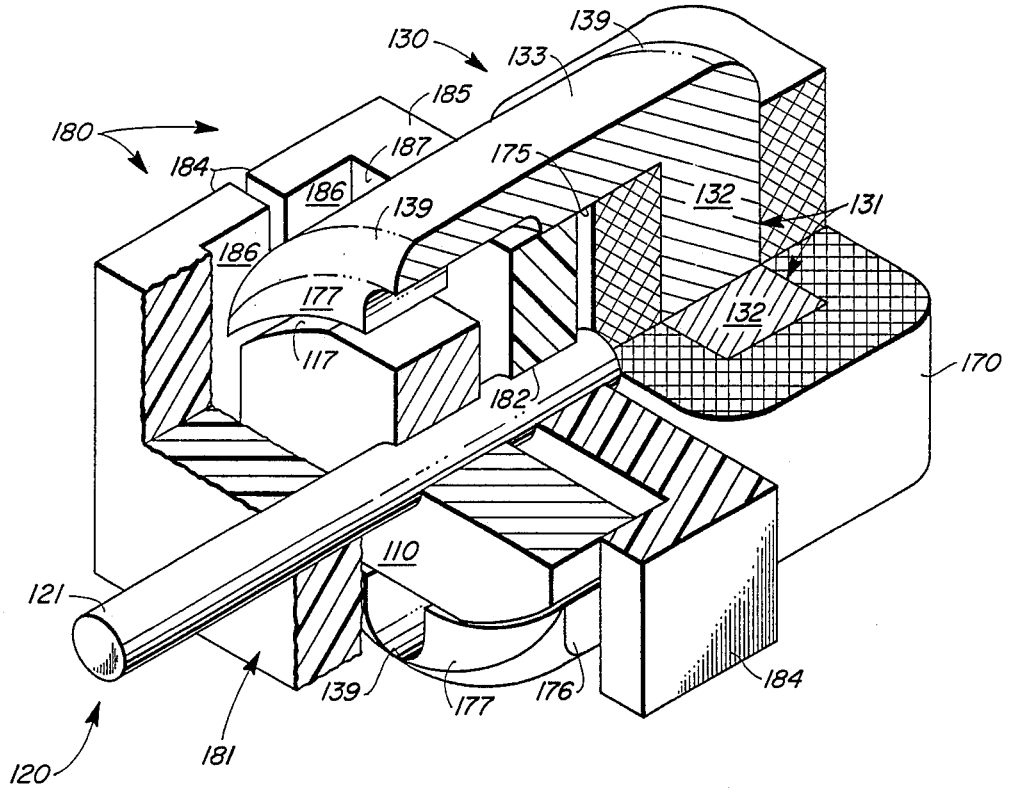
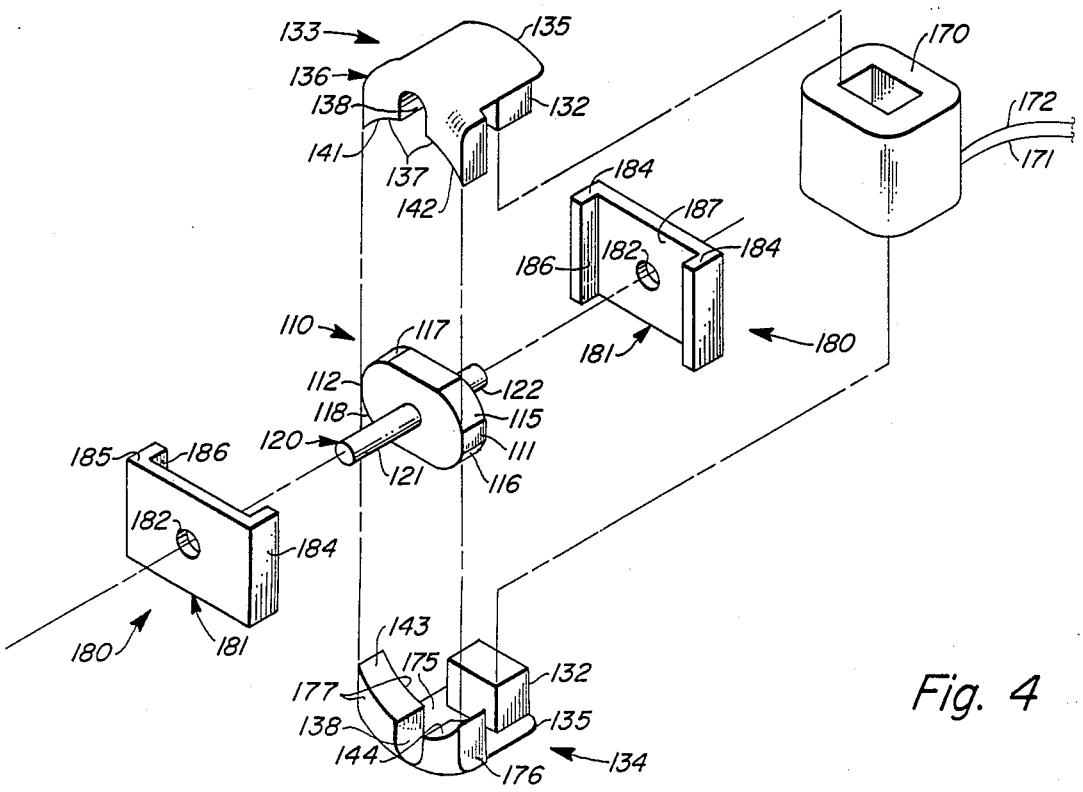
Fig. 4

POLARIZED ROTARY SOLENOID

BACKGROUND OF THE INVENTION

1. Field of the Invention

The subject invention pertains to the field of electric motive power systems. More particularly, the invention pertains to oscillating motors with energizing winding circuit control.

2. Description of the Prior Art

In rotary solenoids electrical energization of a winding produces oscillating movement of a shaft. In certain prior art rotary solenoids magnetic attraction generated by energization of the winding attracts an armature to move the shaft in one direction and tensions a coil spring which moves the shaft in the other direction when the winding is deenergized. In this type of prior art rotary solenoids it is difficult to provide equal torque in both directions since electromagnetism is the motive power in one direction and resilient energy is the motive power in the other direction. This type of rotary solenoid is subject to failure if the spring breaks and becomes ineffective if the spring weakens. These problems are avoided by another type of prior art rotary solenoid which utilizes a separate winding for each direction of movement. However, the use of two windings results in a structure which is relatively heavy, bulky, and expensive in relation to the single winding, spring returned type. Both of these types of rotary solenoid are subject to improper operation when a circuit for energizing a winding fails, and the direction of movement on such failure is unpredictable since the circuit may fail either on or off.

In solenoid operated devices where great reliability is required, it is known to use a direct current energizing circuit which outputs a predetermined number of alternate positive and negative pulses. This arrangement is effective since it is unlikely that any single energizing circuit failure will produce this number of such pulses. It is apparent that neither of the above types of prior art rotary solenoid is suited for use with such an energizing circuit.

It is often desireable to maintain the shaft of a rotary solenoid in the extreme positions of its oscillating movement. In prior art solenoids the necessary detent action for this purpose is obtained either by mechanical elements, which requires greater weight and expense, or by maintaining electrical energization of the winding which requires a continuous power drain and cannot be used to maintain the shaft in a position to which it is urged by a spring.

Polarized relays, in which different switching functions occur on application of opposite polarity direct current to a winding, are well-known. It is also known to utilize direct current polarized actuation where great reliability is required, as in certain signaling applications. However, insofar as is known to the applicant, prior art polarized devices for these purposes are not suited for a use as a rotary solenoid, particularly where a relatively high torque, compact, efficient, and rugged actuator is required.

SUMMARY OF THE INVENTION

The subject invention is a rotary solenoid having a pivotally mounted permanent magnet armature whose opposite poles are each disposed between a pair of oppositely polarized electromagnetic poles so that opposite direct current energization of a winding for the electromagnetic poles urges the armature in opposite directions and so that permanent magnetism of the armature maintains the armature in the extreme positions of its movement. The invention is particularly suited to a compact and rugged rotary solenoid in which a pair of U-shaped nonferromagnetic elements provide pivotal mounting for a shaft supporting the armature between the elements and between same polarity electromagnetic pole pairs embraced by these elements and extended therebetween from a winding disposed at one end of the shaft.

It is an object of the present invention to provide a rotary solenoid which is particularly suited to applications where extreme reliability is required.

It is, therefore, an object of the present invention to provide a rotary solenoid where movement in opposite directions is obtained by opposite direct current energization of a single winding and without the use of a resilient element.

Another object is to provide such a rotary solenoid in which the output element is maintained in its extreme positions without springs, mechanical detents, or continuous application of electric power.

It is a further object to provide a rotary solenoid structure which meets the above objects and is rugged and compact.

A still further object of the present invention is to provide a rotary solenoid which is fully effective, light in weight, and economical in construction.

BRIEF DESCRIPTION OF THE DRAWINGS

Other objects, advantages, and novel features of the subject invention will become apparent from the following detailed description thereof when considered with the accompanying drawings in which:

FIG. 1 is a perspective view of a rotary solenoid which is a particularly simple first embodiment of the subject invention;

FIGS. 2A and 2B are somewhat schematic views taken from the position of line 2 in FIG. 1, and showing an armature of the solenoid in opposite pivotal positions;

FIG. 3 is a perspective view of a particularly compact and rugged embodiment of the subject invention with portions broken away to show the interior arrangement; and FIG. 4 is an exploded perspective view of the embodiment of FIG. 3.

DESCRIPTION OF THE PREFERRED EMBODIMENT FIRST EMBODIMENT

In FIGS. 1, 2A, and 2B is shown a rotary solenoid which is a first embodiment of the subject invention.

This solenoid has an armature 10 which is generally elliptical disc having opposite end or pole portions 11 and 12. Armature 10 is elongated and permanently magnetized along a magnetic axis, not shown but extending between pole portions 11 and 12 so that these portions are of opposite magnetic polarity. In FIGS. 2A and 2B pole portions 11 anad 12 are represented respectively, as of north and south polarity as indicated by the letters "N" and "S". Armature 10 bears four pole faces 15, 16, 17, and 18 which are angularly spaced about the periphery of the armature and are generally coplanar. Faces 15 and 16 are adjacent and disposed on pole portion 11 oppositely of this pole portion and of the magnetic axis. Faces 16 and 17 are similarly disposed in relation to pole portion 12. It is evident that one adjacent pair of such faces, faces 15 and 16, are of the same north polarity and that the other adjacent pair of such faces, faces 17 and 18, are of the same south polarity and thus of opposite polarity to the one pair of faces. Each face 15–18 has a well-known arcuate configuration about a center point spaced from the armature oppositely of the face to provide desirable torque characteristics when the armature is electormagnetically motivated as subsequently described.

The solenoid of FIGS. 1, 2A, and 2B has a shaft 20 extended centrally through armature 10 and fixedly connected thereto for movement therewith. Shaft 20 extends from the armature in a direction normal to the plane of faces 15–18 and terminates in a mechanical drive end portion 21 configured in any suitable manner to provide pivotal output movement from the solenoid. It is evident that each pair of the faces 15–18 disposed on armature portions 11 and 12 is opposite a plane defined by the axis of shaft 20 and the magnetic axis between these armature portions. It is alos evident that armature 10 extends transversely of shaft 20 with armature portions 11 and 12 being opposite of the shaft.

The solenoid has a bearing bridge 25 constructed of any suitable nonferromagnetic material such as aluminum or plastic. Bridge 25 is elongated in a direction transversely of shaft 20 and armature 10 and has opposite ends 26. Centrally, bridge 25 has a bearing 27 through which shaft 20 extends in pivotally supported relation with the bridge adjacent to armature 10. Bearing 27 is disposed between armature 10 and shaft drive end portion 21 and, by way of shaft 20, supports the armature for pivotal movement about the axis of shaft 20 together with the shaft so that the shaft serves to output such armature movement from the solenoid. Bearing 27 is depicted as a bushing in FIG. 1, but may be a ball bearing or, simply, the surface of a bore through bridge 25.

The solenoid of FIGS. 1, 2A, and 2B has a unitary ferromagnetic element 30 having an elongated central or core member 31 disposed at one side of armature 10 and extending generally transversely of the armature in the plane of its faces 15–18. Element 30 has a pair of arms or pole pieces 33 and 34 disposed generally in said plane and extending individually from the opposite ends of member 31 oppositely of the armature. Referring to FIG. 2A, it is seen that arms 33 and 34 have individual proximal end portions 35 interconnected by core member 31 and individual pole regions or distal portions 36 which are adjacent to armature 10 and are bifurcated and turn toward armature 10 at opposite sides thereof transversely of the magnetic axis between armature portions 11 and 12. Arm portions 35 and 36 thus each have a pair of branches 37 spaced by a gap 38 which provides magnetic separation therebetween. As shown in FIGS. 2A and 2B, the branches 37 of each arm 33 and 34 diverge toward armature 10 in a direction transversely of shaft 20, and the four branches terminate individually in a first pole surface 41, a second pole surface 42, a third pole surface 43, and a fourth pole surface 44. Pole surfaces 41–44 are individually juxtapositioned at and conform in arcuate shape to, respectively, pole faces 17, 15, 18, and 16. Arm 33 bears pole surfaces 41 and 42 and arm 34 bears pole surfaces 43 and 44; surfaces 41 and 43 are aligned in facing relation oppositely of armature portion 12 of south polarity; and surfaces 42 and 44 are aligned in facing relation oppositely of armature portion 11 of north polarity. Pole surfaces 41 and 43 are spaced further apart than faces 17 and 18, and pole surfaces 42 and 44 are spaced further apart than faces 15 and 16 so that armature 10 is pivotable in opposite directions between the pole surfaces and between a first extreme armature position 46 shown in FIG. 2A and a second extreme armature position 47 shown in FIG. 2B. Engagement of each pole face 15–17 with the corresponding conforming one of the surfaces 41–44 determines positions 46 and 47. Ends 26 of nonferromagnetic bridge 25 are individually and fixedly connected in any suitable manner, not shown, to end portions 36 of ferromagnetic arms 33 and 34. Bridge 25 thus supports shaft 20 and armature 10 in relation to ferromagnetic element 30 for pivotal movement of the armature relative thereto and magnetically separates armature 10 and element 30. It is apparent that shaft 20 is supported so as to extend in a direction between arms 33 and 34.

The solenoid of FIGS. 1, 2A, and 2B has a electromagnetic winding 70 which is wound about core member 31 as indicated schematically in FIGS. 2A and 2B. Member 31 extends axially through winding 70. Winding 70 has opposite direct current (d.c.) terminals 71 and 72. Winding 70 is wound about core member 31 between the ends thereof so that end portions 35 of arms 33 and 34 are individually juxtapositioned to the opposite ends of the winding.

It is apparent from FIG. 2A that d.c. energization of terminals 71 and 72 with the electric polarity indicated thereat in FIG. 2A magnetizes the pole surfaces 41 and 42 with the same north magnetic polarity, as indicated by the letter "N", and magnetizes the pole surfaces 43 and 44 with the same south magnetic polarity, as indicated by the letter "S". The pair of these surfaces borne by arm 33 thus have opposite magnetic polarity to the pair of these surfaces borne by arm 34. As a result of interaction between magnetic fields of faces 15–18 and surfaces 41–44 when terminals 71 and 72 are energized electrically with the polarity shown in FIG. 2A, armature 10 is magnetically motivated to pivot toward its position 46. It is apparent that, with polarities as shown in FIG. 2A, armature end portion 11 is drawn toward its adjacent pole surface 44 and is repelled from its adjacent surface 42 while end portion 12 is drawn toward surface 41 and repelled from surface 43 imparting pivotal movement to shaft 20 in a direction indicated by arrow 75. As shown in FIG. 2B, reversal of the polarity of d.c. energization of terminals 71 and 72 from the polarity of such energization as shown in FIG. 2A reverses the magnetic polarity of arms 33 and 34 and surfaces 41–44 from that shown in FIG. 2A while the polarity of permanently magnetized armature pole faces 15–17 is unchanged. As a result, armature 10 is magnetically motivated to pivot in a direction 76 which is opposite direction 75. It is apparent, therefore, that reversing the d.c. polarity of terminals 71 and 72 reverses the direction of pivotal movement of armature 10 and shaft drive end portion 21 without the use of a spring or other resilient element. Since armature 10 and ferromagnetic element 30 are symetric about a magnetic axis between armature ends 11 and 12, equal torque and equal torque variation exist during corresponding portions of pivotal movement in either direction 75 or 76.

It is also apparent that the permanent magnetic attraction of armature 10 for ferromagnetic element 30 causes the armature to be retained in either of its positions 46 and 47 after winding 70 is deenergized and when a pair of pole faces 15–17 are engaged with the corresponding pair of the surfaces 41–44 of arms or pole pieces 33 and 34.

SECOND EMBODIMENT

In FIGS. 3 and 4 is shown a rotary solenoid which is a second embodiment of the present invention. Certain elements of the second embodiment, which are similar in structure and function to corresponding elements of the first embodiment, are identified with numerals having a value one hundred higher than the numerals identifying said corresponding elements.

The solenoid of FIGS. 3 and 4 has a permanently magnetized armature 110 substantially identical to armature 10 in having opposite end portions 111 and 112 and pole faces 115, 116, 117, and 118. This solenoid has a shaft 120 having a drive end portion 121 extended in one direction from armature 110 and has an opposite end portion 122 extended oppositely therefrom so that armature 110 is fixedly and centrally mounted on shaft 120 for pivotal movement therewith.

The solenoid of FIGS. 3 and 4 has a ferromagnetic element or structure 130 having a central core member 131 which extends transversely of shaft 120 adjacent to its end portion 122 and is disposed oppositely of this shaft end portion from the other shaft end portion 121. For a purpose subsequently explained, member 131 is constructed in two halves 132 as shown in FIG. 4. Each half 132 is unitarily constructed with one of the pole pieces or arms 133 and 134 of element 130. Each arm 133 or 134 has an end portion 135 individually joined to the corresponding half 132. Arm 133 and the corresponding half 132 of member 131 are substantially identical to arm 134 and its half of this member. Arms 133 and 134 are similar to arms 33 and 34 in that each has a bifurcated end portion or pole region 131 separated into two branches 137 by a gap indicated in FIG. 4 by numeral 138. Arms 133 and 134 are preferably curved in a well-known manner at certain places, indicated by numeral 139 in FIG. 3, to eliminate sharp edges and minimize fringing of magnetic fields in these arms.

Arm 133 bears pole surfaces 141 and 142 which, respectively, are juxtapositioned at and conform to pole faces 117 and 115 of armature 110, and arm 134 bears pole surfaces 143 and 144 which, respectively, are juxtapositioned at and conform to armature pole faces 118 and 116. In the assembled solenoid of FIGS. 3 and 4, as best shown in FIG. 3, halves 132 of member 131 are disposed in engaging relation and extend centrally through a winding 170. As shown in FIG. 4, winding 170 has opposite d.c. terminals 171 and 172. Typically, an electromagnetic structure formed by winding 170, member 131, and arms 133 and 134 is assembled by inserting halves 132 with their associated arms 133 and 134 into previously wound winding 170 and fixing these elements together in any suitable manner, as by a ferromagnetic pin not shown, extending lengthwise of member 131 and inserted through suitable bores in halves 132 thereof. Shaft 120 is mounted on this structure in a manner shortly to be described so that armature 110 with its faces 115–118 is disposed in relation to surfaces 141–144 of element 130 in an arrangement similar to the arrangement of faces 15–18 and surfaces 41–44. Armature 110 can thus be electromagnetically pivoted in opposite directions between arm end portions 135 by opposite polarity d.c. energization of terminals 171 and 172. Armature 110 is similar to armature 10 in being maintained in either of its extreme positions by permanent magnetic attraction for element 130 after winding 170 is deenergized.

It is apparent that assembled structure 130 is generally U-shaped and embraces armature 110 and shaft end portion 122 with core member 131 extended transversely oppositely thereof in a direction generally orthogonal to a magnetic axis extending between armature end portions 111 and 112. It is also apparent that arms 133 and 134 extend oppositely of shaft 120 and generally therealong to arm end portions 136. Arm end portions 136 extend transversely of the balance of arms 133 and 134 and are disposed at and extend along armature 110 in a direction between its end portions 111 and 112 as best shown in FIG. 4.

Each arm 133 or 134 bears a first planar surface 175 which is parallel to shaft 120 and extends between end portion 136 of the arm and core member 131. Surfaces 175 are disposed parallel to each other and in facing relation. The end portion 136 of each arm 133 or 134 bears a pair of second planar surfaces 176 which are substantially parallel to shaft 120 and to each other, but are orthogonally related to surfaces 175. When the solenoid of FIGS. 3 and 4 is assembled, surfaces 176 of each arm 133 or 134 face oppositely outwardly from armature 110 with the surfaces 176 individually adjacent to armature end portions 111 and 112 and aligned with the corresponding one of these surfaces of the other one of the arms. Each end portion 136 of arm 133 or 134 bears a pair of opposite third planar surfaces 177 which are normal to shaft 120 and surfaces 176, these third planar surfaces extending on each side of the braches 177 of the end portion and facing oppositely of these branches in a direction along the shaft with each such third surface of one arm 133 or 134 aligned axially of the shaft with the corresponding such surface of the other arm.

The solenoid of FIGS. 3 and 4 has a pair of substantially identical bearing blocks 180 constructed of any suitable nonferromagnetic material, preferably a relatively rigid plastic material also suited for use as a bearing material. Blocks 180 are generally U-shpaed, each having a central rectangular portion 181 extending, in the assembled solenoid, transversely of shaft 120 in a direction generally along the magnetic axis between the end portions 111 and 112 of armature 110. In the assembled solenoid, block central portions 181 are disposed in axially spaced relation along shaft 120 and are disposed oppositely of armature 110 and of pole portions 136 or arms 133 and 134. Each bearing block portion 181 has a centrally disposed bore 182 through which, in the assembled solenoid, extends the corresponding one of the shaft end portions 121 or 122, with the surfaces of these blocks provided by bores 182 serving as bearing surfaces for the shaft 120 so that the shaft and armature 110 are supported for pivotal movement in relation to ferromagentic arm portions 136. Shaft output end portion 121 extends beyond its corresponding block 180 while shaft portion 122 does not extend substantially from bore 182 of the other block 180. Each block 180 has a pair of arms 184 which, when the solenoid is assembled, extend in a direction along shaft 120 from the ends of central portion 181 of the block oppositely of end portions 135 of arms 133 and 134 and in engagement with surfaces 176, blocks 180 being disposed so that their arms 184 extend toward each other anad embrace ferromagnetic arm portions 136.

Each bearing block 180 bears a pair of opposite, parallel, outwardly facing first planar surfaces 185 extending across the block central portion 181 and its arms 184. Surfaces 185 are disposed and spaced so as to fit individually in parallel, slidable engagement between first surfaces 175 of arms 133 and 134. Bearing block arms 184 bear individual second planar surfaces 186 which are parallel and disposed in facing relation inwardly of arms 184 so as to conform in slidably fitted relation to second surfaces 176 of arms 133 and 134. Each bearing block central portion 181 bears a third planar surface 187 extending normal to surfaces 176 and between the bearing block arms 184.

The solenoid of FIGS. 3 and 4 is thus configured for assembly by sliding one of the bearing blocks 180 transversely of the assembled position of shaft 120 and between arms 133 and 134 with surfaces 175 and 185 engaging until surfaces 176 and 186 align. This bearing block 180 is then moved in a direction along the assembled position of shaft 120 toward arm end portions 136 until arms 184 of this bearing block embrace these arm end portions. This movement is continued with surfaces 176 and 186 sliding in engagement until surface 187 of the block engages the facing one of the surfaces 177, thereby fixing this one of the blocks 180 in position relative to the ferromagnetic element 130. Shaft 120 and armature 110 are then moved so as to insert shaft end portion 122 into the bearing bore 182 of the block and to position armature 110 between pole surfaces 141–144.

The bore 182 of the other one of the bearing blocks 180 is then placed over shaft output portion 120, and the surfaces 186 of this block aligned with surfaces 176. This other bearing block is then moved along shaft 120 until arms 184 of this block embrace arm end portions 136. This movement is continued with surface 176 sliding in engagement with surfaces 186 of this block 180 until surface 187 thereof engages the ferromagnetic end potion surfaces 177, thereby positioning this block, shaft 120, and armature 110 in relation to ferromagnetic element 130. It is evident that, by suitable tolerances between surfaces 175–177 and 185–187, the various elements of the relatively compact and rugged rotary solenoid of FIGS. 3 and 4 can be quickly and conveniently assembled into proper operating alignment without use of jigs or supplemental fasteners.

Obviously many modifications and variations of the present invention are possible in light of the above teachings. It is therefore to be understood that the invention may be practiced within the scope of the following claims other than as specifically described above.

What is claimed is:

1. A rotary solenoid comprising:

a shaft pivotable about the axis thereof and having a mechanical output end portion and an opposite end portion;

a permanently magnetized armature fixedly mounted centrally on the shaft, the armature having a pair of pole portions of opposite magnetic polarity disposed oppositely of the shaft along a magnetic axis extending transversely thereof and each pole portion having a pair of pole faces of the same magnetic polarity disposed oppositely of the plane of said axis;

a generally U-shaped ferromagnetic structure embracing the armature and said opposite end portion of the shaft and having a central portion disposed adjacent to said opposite end portion and extended transversely oppositely thereof in a direction generally orthogonal to the magnetic axis, and a pair of arms extending from said central portion oppositely of the shaft and generally therealong to the armature, each arm having a pole region terminating the arm of the armature, the pole region being bifurcated and extending transversely of the shaft generally along said magnetic axis and bearing a pair of pole surfaces individually juxtapositioned to a pair of said pole faces which are of opposite magnetic polarity, each pair of said pole surfaces which are individually borne by said arms and which correspond to a pair of pole faces having the same magnetic polarity being spaced further apart transversely of the magnetic axis than said pair of pole faces so that the armature is pivotable oppositely between said pole surfaces;

said arms having individual first planar surfaces extending between said central portion of the ferromagnetic structure and said pole region of each arm, said first surfaces being substantially parallel to each other and to the shaft and being disposed in facing relation; and said pole regions having a pair of second planar surfaces substantially parallel to the shaft and orthogonally related to the first planar surfaces, said second surfaces facing oppositely outwardly from the armature and each of said second surfaces being adjacent to one of said pole portions thereof;

a pair of bearing blocks of nonferromagnetic material mounted on the ferromagnetic structure and extended generally along said magnetic axis, the bearing blocks having individual bearing surfaces through which said end portions of the shaft extend in pivotally supported relation with said output end portion extending beyond the corresponding bearing block and with the armature being supported by said bearing surfaces and the shaft for opposite pivotal movement between said pole surfaces; and said bearing blocks being substantially identical and generally U-shaped, each of said blocks having a pair of arms which inwardly and individually conform in slidably fitted relation to said second planar surfaces and having a central portion in which the corresponding bearing surface is disposed centrally and which has a pair of parallel planar surfaces facing outwardly therefrom and spaced for slidable engagement of the bearing block between said first planar surfaces, so that the solenoid is configured for assembly by sliding one of said bearing blocks between said first planar surfaces in a direction transversely of the shaft and moving the bearing blocks in a direction along the shaft toward said pole regions so that the arms of the bearing blocks slide along said second planar surfaces and embrace said pole regions thereby retaining the bearing blocks in position relative to the ferromagnetic structure; and a winding having opposite electric terminals and disposed about said central portion of the ferromagnetic structure so that direct current energization of said terminals electromagnetically generates opposite magnetic polarization of said pole regions of said arms so that reversal of the polarity of such energization reverses said magnetic polarization and reverses the direction of said pivotal movement.

* * * * *